US005638081A

United States Patent [19]

MacDonald et al.

[11] Patent Number: 5,638,081

[45] Date of Patent: Jun. 10, 1997

[54] ANTENNA FOR ENHANCED RADIO COVERAGE

[75] Inventors: Alan MacDonald, Bellevue, Wash.; Jake Rasweiler, Paramus, N.J.

[73] Assignee: AT&T, Middletown, N.J.

[21] Appl. No.: 490,563

[22] Filed: Jun. 15, 1995

Related U.S. Application Data

[63] Continuation-in-part of Ser. No. 482,266, Jun. 7, 1995, abandoned.

[51] Int. Cl.[6] ..... H01Q 1/22; H01Q 1/42

[52] U.S. Cl. ..... 343/818; 343/872; 343/890

[58] Field of Search ..... 343/872, 818, 343/834, 873, 890–892; H01Q 1/12, 1/40, 1/42, 1/22, 21/01

[56] References Cited

U.S. PATENT DOCUMENTS

| | | | |
|---|---|---|---|
| 2,594,839 | 4/1952 | Alford | 343/818 |
| 2,720,590 | 10/1955 | Nail et al. | 343/818 |
| 2,770,801 | 11/1956 | Jones | 343/834 |
| 2,831,187 | 4/1958 | Harris et al. | 343/818 |
| 3,059,322 | 10/1962 | Teague | 343/818 |
| 3,482,253 | 12/1969 | Zucconi | 343/834 |

OTHER PUBLICATIONS

U.S. application No. 29/041,755 filed on Jun. 7, 1995, and allowed on Aug. 16, 1996.

*Primary Examiner*—Michael C. Wimer
*Attorney, Agent, or Firm*—Jeffrey M. Weinick

[57] ABSTRACT

An antenna for use in urban areas and the like, wherein the antenna is of a design that can be attached to the exterior corner of a building. The antenna is designed to be a low-profile configuration and conformal so as to maximize the aesthetic quality. The antenna also has a continuous backplane so as to create a radiation pattern that will allow substantially complete coverage of an intersection that is adjacent to the location of the antenna.

20 Claims, 2 Drawing Sheets

ANTENNA FOR ENHANCED RADIO COVERAGE

This application is a continuation-in-part of application Ser. No. 08/482,266, filed Jun. 7, 1995, now abandoned.

FIELD OF THE INVENTION

The invention relates to an antenna for transmitting and receiving signals for a cellular or messaging network. More particularly, the invention relates to an antenna configured to be mounted on building corners and the like so as to transmit and receive signals in crowded, urban areas where buildings and other structures remove the ability to use conventional cellular antenna towers and antennas.

BACKGROUND OF THE TECHNOLOGY

Over the past two decades, the popularity and availability of cellular telephones and other telecommunication devices such as pagers has grown dramatically. Cellular networks consist of multiple cells which receive and transmit radio waves to cellular telephones. The geographic area of each cell is served by a cell site, which is comprised of antennas, radio equipment and transmission equipment that allows the cell site to operate with the cellular network.

The original cellular networks were established using omnidirectional antennas of a high gain, allowing a broad area of coverage by each cell site. These cells which cover large geographic areas are typically termed macrocells. A macrocell contains a limited number of radio channels, which limits the amount of traffic the macrocell can process at any given moment. Neighboring macrocells use separate radio channels to prevent co-channel interference problems. To enhance capacity, radio channels are reused at cell sites distant to each other. This spatial separation reduces co-channel interference problems. However, as demand for cellular communications increases, the capacity of macrocells is exceeded, especially in highly populated, urban areas.

To expand cellular capacity, a method of locally reusing cellular radio channels is needed. To accommodate this, cellular networks have added low-power, more localized microcells to the system of powerful macrocells. Microcells can be characterized by their low antenna height, low transmitter power and small coverage area. Directional microcell antennas enhance localized coverage and capacity by radiating radio-frequency (RF) energy into a small, defined area.

A particularly difficult area to maintain coverage is the area located directly away from the corner of a building, and especially when there are a group of buildings as in large downtown or urban areas. This is due to the irregular shape of the area to be covered, which is typically an intersection of two streets. One type of prior art antenna that has been used in such circumstances is a directional panel antenna. Such panel antennas are typically mounted parallel to the sides of buildings. A panel antenna has a solid backplane with an enclosing radome, making it ideal for use close to street level on the sides of buildings where aesthetics prohibit the use of uncovered, screen backplanes. Because most intersections are located at the corner of buildings in urban areas, the resulting radiation pattern from a single antenna mounted parallel to one side of the building does not extend around the building corner to cover the entire intersection.

In an effort to achieve full coverage of an intersection, prior art systems have included two separate panel antennas, each installed on an adjacent side of the building near the intersection. The two antennas are interconnected to a base station with the use of a power combining network, in a configuration that is typically known as co-phasing. This installation requires two panel antennas per intersection.

Requiring multiple antennas not only increases costs and aesthetic impact, but even with several antennas, the intersection is not completely covered. The radiation pattern of two co-phased panel antennas creates a null signal area in the center of the intersection along with destructive interference nulls at other points in the pattern. When a cellular telephone user enters one of the null signal areas in the intersection, transmission and reception ability is degraded. Thus, what is needed is an antenna configuration that provides a smooth and consistent radiation pattern throughout the intersection that avoids this degradation in reception, is aesthetically acceptable, and is cost effective as compared to prior art systems.

SUMMARY OF THE INVENTION

The present invention satisfies the aforementioned needs by providing a convex continuous backplane, low-profile antenna that mounts on the corner of a building or other structure and achieves a broad beamwidth radiation pattern covering substantially an entire urban intersection. The broad beamwidth allows cellular network users to maintain consistent signal strength as they pass through and around the intersection.

The antenna is of a design that can mount on the corner of a building close to street level. Because a microcell antenna operates at a low-power level and because of the need for the microcell to be localized, the antenna is usually mounted low on a structure for the antenna to be effective. Subsequently, microcell antennas will be more visible to the public. Therefore, a low-profile, aesthetically pleasing design is desired.

The body of the antenna itself is formed at approximately a right angle which can be mounted on and extend about the corner of the building. The exact size of the antenna is determined by the frequency for which the antenna is designed. Current frequencies in use in cellular networks include 800 MHz for cellular communications, 900 MHz for messaging, and 1900 MHz for Personal Communication Systems (PCS). The convex continuous backplane serves as a ground plane for the radiating antenna element. To reduce the effect of the building on the radiation pattern, each side of the convex backplane should extend one-half wavelength. The preferred embodiment uses a halfwave dipole centered and separated approximately one quarter wavelength from the apex of the convex backplane. The backplane serves to minimize the effects of building material and construction on the radiation pattern of the dipole.

The combination of the halfwave dipole and the convex continuous backplane provides the broad beamwidth necessary to cover an intersection or other area not currently covered by a single flat panel antenna. Also, by creating a convex continuous backplane, the antenna may be mounted directly to the corner of a building. By mounting the antenna on the corner of a building, the number of antennas needed to achieve the desired coverage as compared to the flat panel antennas is cut in half and the need to co-phase multiple antennas is avoided. This not only minimizes any negative aesthetic effect, but it also substantially decreases the cost to establish the microcell and improve coverage in the intersection.

DETAILED DESCRIPTION OF THE PREFERRED EMBODIMENTS

The present invention is directed to an antenna that can be mounted on a building so that the resulting radiation pattern of the antenna will cover an entire intersection. It is also desirable for the antenna to be of a low-profile design for minimal aesthetic impact.

Figure 1A:
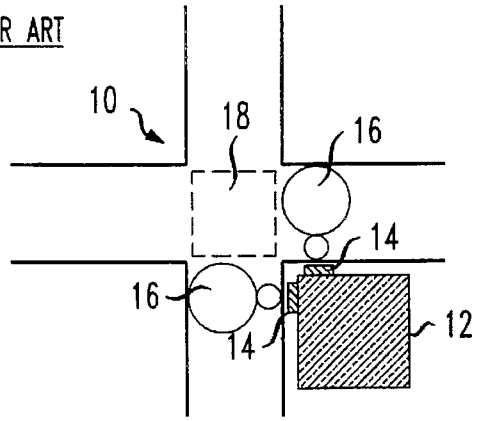
FIG. 1A PRIOR ART
FIG. 1A is a plan view of an intersection with the radiation pattern of two prior art panel antennas shown

FIG. 1 illustrates a typical intersection 10 with a pair of prior art panel antennas 14 mounted on a building 12. For typical flat panel antennas, the radiation patterns 16 may vary from approximately 60 to 120 degrees of horizontal beamwidth. The size of the beamwidth will change in inverse proportion to the width of the back panel of antenna 14. The maximum radiation patterns 16 of typical flat panel antennas are generally about 120 degrees of horizontal beamwidth. As shown in FIG. 1A, in which the two flat panels are not co-phased, even with both panels at a maximum horizontal beamwidth, the combination of the radiation patterns 16 will not completely cover the intersection 10. Because of this, a user of a cellular network passing through the intersection 10 may enter an area not covered by the radiation pattern 16 of either panel antenna 14. This area is illustrated as null signal zone 18. When a user of the cellular network enters the null signal zone 18, signal loss to the cellular equipment may cause a momentary break in coverage or even disconnect the user completely from the cellular network. It is the goal of the present invention to minimize or eliminate the null signal zone 18.

Figure 1B:
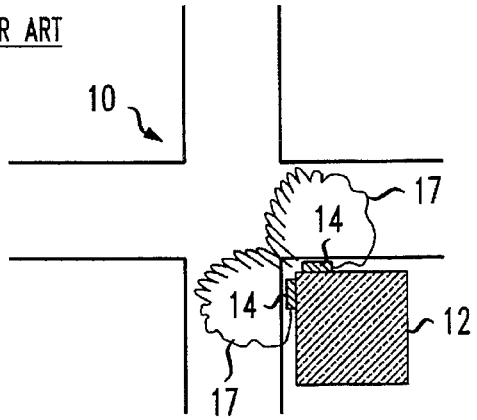
FIG. 1B PRIOR ART
FIG. 1B is a plan view of an intersection with the radiation patter of two co-phased prior art panel antennas shown.

Both panel antennas 14 may be interconnected to a base station, in an arrangement typically known as co-phasing. FIG. 1B shows the resultant pattern 17 of co-phased flat panels 14. The radiation pattern nulls produced by destructive signal interference produce even greater areas of poor signal strength.

Figure 2:
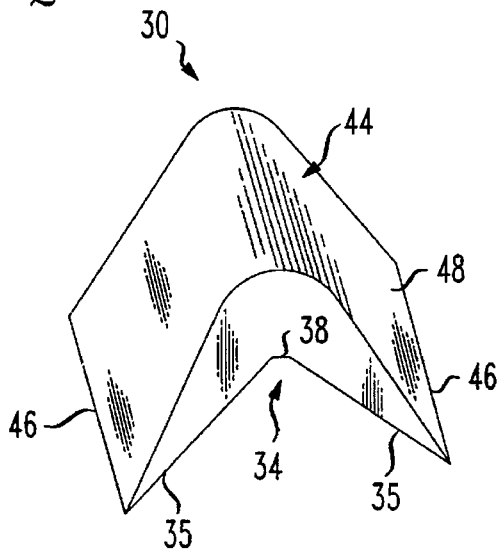
FIG. 2 is a perspective view of one presently preferred embodiment of the antenna of the present invention.

FIG. 2 illustrates a view of one preferred embodiment of the microcell antenna 30 of the present invention. The microcell antenna 30 includes a continuous conductive backplane generally indicated at 34. The metal backplane 34 should be composed of an electrically conductive material. The conductive backplane 34 may also be of a solid-rod backscreen design of a type that is well known in the art, without changing the spirit of the invention. The conductive backplane 34 includes two plates or screens 35, that are joined by a center section 38, so that the plates or screens 35 extend in directions such that they form an interior angle of approximately 90 degrees with respect to each other.

A radome 44 is used to protect the antenna 30 from the elements and to increase the aesthetic quality of the antenna 30. To maximize aesthetic quality and minimize size, the radome 44 is tapered, with a maximum depth from the center section 38 of the backplane 34 to an outer face 48 of the radome 44. The depth of the radome 44 at this location will be slightly larger than the separation of the dipole 32 from the backplane 34. From this maximum depth, travelling outwardly along the outer face 48 toward both edges, the radome 44 slopes toward backplane ends 46. The distance between the outer face 48 of the radome 44 and the backplane 34 gradually decreases until the two connect at ends 46. This design presents a low-profile antenna 30 that will minimize detraction from the aesthetics of a building while achieving the desired operation and radiation pattern characteristics.

Figure 3:
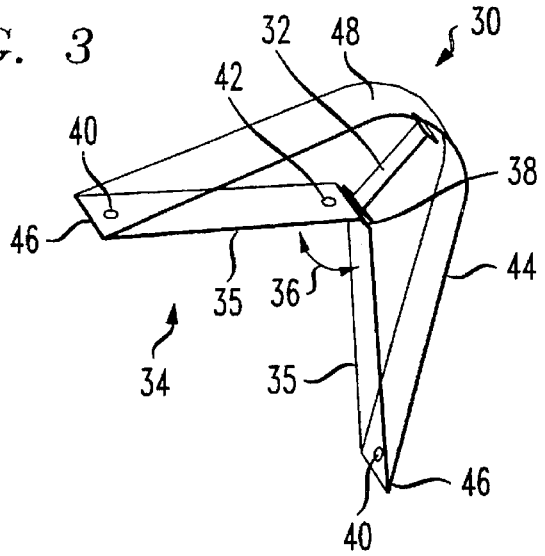
FIG. 3 is a perspective diagrammatic view of one presently preferred embodiment of the antenna of the present invention with a portion of the radome removed to reveal the halfwave dipole contained in the radome.

FIG. 3 illustrates a view of the inside of one preferred embodiment of the microcell antenna 30 of the present invention. A dipole 32 is attached to the center section 38 of the metal backplane 34, situated below the apex of the radome 44. The dipole 32 is a standard halfwave dipole as is commonly known and used in the art, tuned to a desired wavelength. The length of the dipole 32 is defined by the frequency to which the dipole 32 is tuned, and is approximately one-half wavelength long. The wavelength is proportional to the frequency shown by the formula wavelength=(speed of light)/frequency. Each backplane plate or screen 35 should be approximately the length of one-half wavelength of the signal to which the dipole 32 is tuned. By maintaining a length of one-half wavelength, any electrical effect caused by the composition of the building 12 on which the antenna 30 is to be mounted will be reduced. The antenna 30 may be mounted to the corner of a building 12 by any commonly used method. In one preferred embodiment, mounting holes 40 are drilled in the backplane 34, and the antenna 30 may be secured to the corner of a building by inserting bolts through the mounting holes 40.

The radome 44 is constructed of lightweight fiberglass material and completely encloses one side of the backplane 34 and the dipole 32. This design will protect the dipole 32 and the backplane 34 from wear due to exposure to the elements.

A conventional coaxial electrical connector 42 is attached to the dipole 32 to transmit and receive all signals. The electrical connector 42 is designed to receive a standard coaxial cable as is commonly used with cellular antennas. Although the electrical connector 42 is shown at a specific location on the backplane 34, the location of the connector 42 will not change the function of the antenna 30 and may therefore be placed anywhere on the backplane 34.

Figure 4:
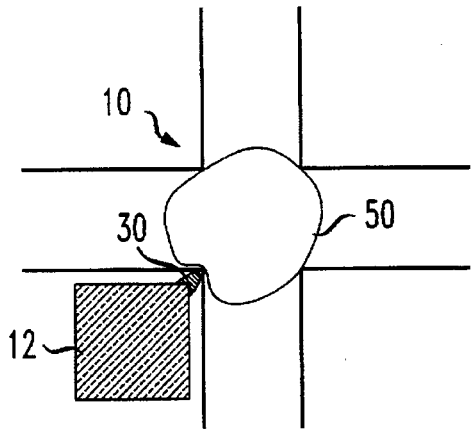
FIG. 4 is a plan view of an intersection, illustrating the radiation pattern produced by a preferred embodiment of the antenna configured according to the invention as shown and described.

FIG. 4 illustrates the antenna 30 mounted on the corner of a building 12. Due to the radiation characteristics of this antenna design, the 90 degree continuous backplane 34 of antenna 30 creates approximately a 190 degree halfpower horizontal beamwidth radiation pattern 50 as shown. This radiation pattern 50 is sufficient to cover substantially the entire intersection 10. Because the radiation pattern 50 of a single antenna 30 can provide effective coverage for substantially an entire intersection, the use of co-phased flat panels, with their associated radiation patter nulling, can be avoided.

Figure 5:
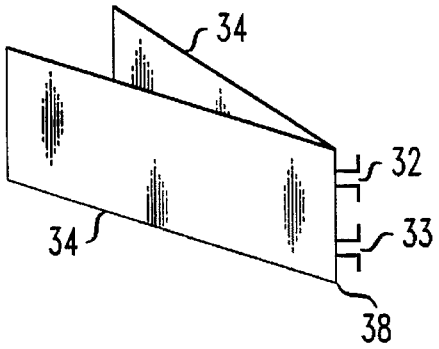
FIG. 5 is a side view of another preferred embodiment of the antenna of the present invention with the radome removed to reveal multiple radiation elements.

FIG. 5 shows an alternative embodiment of the present invention. In this embodiment, a second radiating element 33, here another halfwave dipole, is added to the first halfwave dipole 32. By placing the second radiating element 33 in line and centered on the convex center 38 of the of backplane 34, a narrower vertical radiation pattern beamwidth can be produced. This narrower vertical radiation pattern provides higher antenna gain than the first embodiment. This can be repeated by adding additional radiating elements, further enhancing antenna gain.

Of course, numerous variations and modifications of the invention will become readily apparent to those skilled in the art. Accordingly, the scope of the invention should not be construed as limited to the specific embodiment depicted and described but rather, the scope is defined by the appended claims. The invention may be embodied in other specific forms without departing from its spirit or essential characteristics. The detailed embodiment is to be considered in all respects only as illustrative and not restrictive and the scope of the invention is, therefore, indicated by the appended claims rather than by the foregoing description. All changes which come within the meaning and range of equivalency of the claims are to be embraced within their scope.

What I claim is:

1. An antenna comprising:

a backplane comprising a first section having a front side and a back side;

a second section having a front side and a back side;

said first section connected to said second section at a central portion of said backplane to form an interior angle with respect to the back side;

a radiating element connected to the front side of the central portion of said backplane; and a radome connected to said backplane such that the front side of said backplane and said radiating element are covered by said radome, and such that the distance between the radome and the backplane is at a maximum at said central portion with said distance decreasing in an outward direction from said central portion.

2. The antenna of claim 1 wherein said backplane is a single continuous element.

3. The antenna of claim 1 wherein said radome connects to outer edges of said first and second sections of the backplane.

4. The antenna of claim 1 wherein said backplane is attached to a substantially vertical building surface such that the backplane extends about a corner of the building.

5. The antenna of claim 4 wherein the backplane is substantially adjacent to the building surface on either side of the corner.

6. The antenna of claim 1 wherein said interior angle is approximately 90 degrees.

7. The antenna of claim 1 wherein said backplane is a solid-rod backplane.

8. The antenna of claim 1 wherein said backplane is made of an electrically conducting material.

9. The antenna of claim 1 further comprising a plurality of radiating elements attached to the front side of the backplane.

10. The antenna of claim 1 wherein the radiating element is a halfwave dipole antenna.

11. An antenna comprising;

a backplane having a front side and a back side, said backplane having a first portion and a second portion disposed about a central portion and extending therefrom, such that said first portion and said second portion form an interior angle with respect to the back side;

a radiating element connected to the front side of the central portion of said backplane; and a radome connected to said backplane covering said front side and said radiating element such that the distance between the radome and the backplane is at a maximum at said central portion with said distance decreasing in an outward direction from said central portion.

12. The antenna of claim 11 wherein said backplane is a single continuous element.

13. The antenna of claim 11 wherein said radome connects to outer edges of said first and second portions of the backplane.

14. The antenna of claim 11 wherein said backplane is attached to a substantially vertical building surface such that the backplane extends about a corner of the building.

15. The antenna of claim 14 wherein the backplane is substantially adjacent to the building surface on either side of the corner.

16. The antenna of claim 11 wherein said interior angle is approximately 90 degrees.

17. The antenna of claim 11 wherein said backplane is a solid-rod backplane.

18. The antenna of claim 11 wherein said backplane is made of an electrically conducting material.

19. The antenna of claim 11 further comprising a plurality of radiating elements attached to the front side of the backplane.

20. The antenna of claim 11 wherein the radiating element is a halfwave dipole antenna.

* * * * *

UNITED STATES PATENT AND TRADEMARK OFFICE

CERTIFICATE OF CORRECTION

PATENT NO. : 5,638,081

DATED : June 10, 1997

INVENTOR(S) : Alan MacDonald and Jake Rasweiler

It is certified that error appears in the above-indentified patent and that said Letters Patent is hereby corrected as shown below:

Item [73]

Cover Page in the *Assignee* section. The Assignee should read –AT&T Wireless Services, Inc., Kirkland, WA--.

Signed and Sealed this

Fourteenth Day of July, 1998

Bruce Lehman

*Attest:*

BRUCE LEHMAN

*Attesting Officer*

*Commissioner of Patents and Trademarks*